US012291953B1

(12) United States Patent
Gilbert et al.

(10) Patent No.: US 12,291,953 B1
(45) Date of Patent: May 6, 2025

(54) DUAL-PACKER INJECTION LEACHING SYSTEM AND METHOD

(71) Applicants: David Gilbert, Denver, CO (US); Grant Bonin, North Vancouver (CA)

(72) Inventors: David Gilbert, Denver, CO (US); Grant Bonin, North Vancouver (CA)

( * ) Notice: Subject to any disclaimer, the term of this patent is extended or adjusted under 35 U.S.C. 154(b) by 939 days.

(21) Appl. No.: 17/185,356

(22) Filed: Feb. 25, 2021

Related U.S. Application Data

(60) Provisional application No. 62/981,336, filed on Feb. 25, 2020.

(51) Int. Cl.

| | |
|---|---|
| ***E21B 43/28*** | (2006.01) |
| ***C22B 3/04*** | (2006.01) |
| ***E21B 19/04*** | (2006.01) |
| ***E21B 19/22*** | (2006.01) |
| ***E21B 33/124*** | (2006.01) |
| ***E21B 43/30*** | (2006.01) |

(52) U.S. Cl.
CPC ..... *E21B 43/28* (2013.01); *C22B 3/04* (2013.01); *E21B 19/22* (2013.01); *E21B 33/1243* (2013.01); *E21B 19/04* (2013.01); *E21B 43/305* (2013.01)

(58) Field of Classification Search
CPC ..... E21B 43/28; E21B 19/22; E21B 33/1243; E21B 19/04; E21B 43/305; C22B 3/04; C22B 3/045; B01D 11/02; B01F 23/2323
USPC .... 266/168, 101, 114; 75/44, 739, 711, 723, 75/741, 736, 733
See application file for complete search history.

(56) References Cited

U.S. PATENT DOCUMENTS

| | | | | |
|---|---|---|---|---|
| 4,325,579 | A * | 4/1982 | Kwantes | E21B 34/12 299/5 |
| 4,815,791 | A * | 3/1989 | Schmidt | E21B 43/28 299/5 |
| 7,422,059 | B2 * | 9/2008 | Jelsma | E21B 43/24 166/272.3 |
| 8,021,461 | B2 * | 9/2011 | Seal | E21B 43/283 299/5 |
| 8,986,423 | B2 * | 3/2015 | Lang | C22B 3/04 75/375 |
| 10,155,255 | B2 * | 12/2018 | Seal | B01F 23/29 |
| 10,260,320 | B2 * | 4/2019 | He | E21B 43/12 |
| 11,613,793 | B2 * | 3/2023 | Seal | C22B 3/02 75/712 |

* cited by examiner

*Primary Examiner* — Jessee R Roe
*Assistant Examiner* — Michael Aboagye
(74) *Attorney, Agent, or Firm* — BOOTH UDALL FULLER, PLC; Pacer K. Udall

(57) ABSTRACT

A dual packer injection leaching system with a dual packer assembly and a support structure. The dual packer assembly has an upper packer, a lower packer, and a high dispersion screen disposed between the upper packer and the lower packer. The dual packer assembly is configured to be disposed within a borehole in a leach pile. The support structure is configured to support the dual packer assembly within the borehole. A wire rope couples the support structure to the dual packer assembly. A pneumatic line is configured to inflate the upper packer and the lower packer, and an injection line is configured to provide leachate solution through the high dispersion screen. The dual packer assembly is configured to deliver the leachate solution through the high dispersion screen to an interval of the borehole bounded by the upper packer and the lower packer.

11 Claims, 13 Drawing Sheets

DUAL-PACKER INJECTION LEACHING SYSTEM AND METHOD

CROSS REFERENCE TO RELATED APPLICATIONS

This application claims the benefit of the filing date of U.S. Provisional Patent Application 62/981,336 entitled "DUAL-PACKER INJECTION LEACHING SYSTEM AND METHOD" to Gilbert, et. al. that was filed on Feb. 25, 2020, the disclosure of which is hereby incorporated herein by this reference.

TECHNICAL FIELD

Aspects of this document relate generally to a leaching system, and more specifically to a leaching system involving the use of packers.

BACKGROUND

Many of the processes implemented to mine valued minerals utilize chemical reactions, such as flotation or solvent extraction electrowinning (SXEW), to remove the minerals from the raw ore. Flotation works by adding a chemical to slurry of ground ore and water. The chemical causes the valued mineral to become hydrophobic. Air bubbles are then released into the mixture and the hydrophobic valued mineral attaches to the bubbles, thus rising to the top where it can be collected. On the other hand, SXEW works by taking a solution containing the minerals and applying an electrical current which causes the minerals to precipitate out of the solution. However, the solution containing the valued mineral must be created before the mineral can be precipitated out. This solution is typically obtained through the use of leach piles.

Mineral-laden raw ore is spread out in a leach pile with a uniform thickness of five to ten meters. This leach pile is then sprinkled or drip-irrigated with an acidic leach solution which dissolves the valued minerals and carries them away. An impermeable liner at the base of the leach pile collects the solution containing the dissolved valued minerals and deposits it into a storage pond for further processing with chemical reactions such as SXEW. Heap leaching is a purposely engineered process whereby the ore of a given grade is crushed to a specific grain size before stacking. By comparison, dump leaching is carried out with run-of-mine materials (normally waste rock) which are sprinkled in-situ, as-is. Dump leach piles are often layered, with older leached material forming the lower layers. This allows dump leach piles to be created on top of older piles, thus saving space.

Over time, leach piles develop hydraulic barriers which "blind off" or plug the permeable nature of the leach pile. When this occurs, typical leaching activity ceases to reach lower levels of the leach pile, leaving significant portions of the desired mineral within the leach pile. In addition, the leach pile can become unstable as upper portions of the leach pile become saturated.

SUMMARY

Aspects of this document relate to a dual packer injection leaching system, comprising a dual packer assembly configured to be disposed inside a well casing within a borehole in a leach pile, the dual packer assembly comprising a first upper packer, a first lower packer, and a first high dispersion screen disposed between the first upper packer and the first lower packer, a crane hook configured to support the dual packer assembly during installation of the dual packer assembly inside the well casing, a mobile deployment system configured to be disposed adjacent the borehole, the mobile deployment system comprising a wire rope coiled around a wire rope reel drum, the wire rope further coupled to the dual packer assembly, and a hose reel drum comprising a pneumatic line and an injection line, the pneumatic line coupled to the first upper packer and the first lower packer and configured to inflate the first upper packer and the first lower packer, and the injection line configured to provide leachate solution through the first high dispersion screen, and a support structure coupled to a chain hoist, the chain hoist coupled to the dual packer assembly and configured to support the dual packer assembly and provide for a release of the crane hook from the dual packer assembly, wherein the dual packer assembly is configured to deliver the leachate solution through the first high dispersion screen to a first interval of the borehole bounded by the first upper packer and the first lower packer.

Particular embodiments may comprise one or more of the following features. The dual packer assembly may further comprise a second upper packer, a second lower packer, and a second high dispersion screen disposed between the second upper packer and the second lower packer, wherein the pneumatic line is coupled to the second upper packer and the second lower packer and configured to inflate the second upper packer and the second lower packer and the dual packer assembly is further configured to deliver the leachate solution through the second high dispersion screen to a second interval of the borehole, the second interval lower than the first interval within the borehole and bounded by the second upper packer and the second lower packer. The dual packer injection leaching system may further comprise the wire rope, the injection line, and the pneumatic line coupled together with plastic ties placed at intervals of 3 meters or less. The dual packer injection leaching system may further comprise a leachate solution sprinkler system coupled to the injection line and configured to supply leachate solution to the injection line. The borehole may extend into the leach pile at an incline.

Aspects of this document relate to a dual packer injection leaching system, comprising a dual packer assembly configured to be disposed inside a borehole in a leach pile, the dual packer assembly comprising a first upper packer, a first lower packer, and a first high dispersion screen disposed between the first upper packer and the first lower packer, and a hose reel drum comprising a pneumatic line and an injection line, the pneumatic line coupled to the first upper packer and the first lower packer and configured to inflate the first upper packer and the first lower packer, and the injection line configured to provide leachate solution through the first high dispersion screen, wherein the dual packer assembly is configured to deliver the leachate solution through the first high dispersion screen to a first interval of the borehole bounded by the first upper packer and the first lower packer.

Particular embodiments may comprise one or more of the following features. The dual packer injection leaching system may further comprise a crane hook configured to support the dual packer assembly during installation of the dual packer assembly inside the borehole. The dual packer injection leaching system may further comprise a support structure coupled to a chain hoist, the chain hoist coupled to the dual packer assembly and configured to support the dual packer assembly. The borehole may extend into the leach pile at an incline. The dual packer injection leaching system may further comprise a wire rope coiled around a wire rope reel drum and the wire rope may be further coupled to the dual packer assembly. The dual packer injection leaching system may further comprise the wire rope, the injection line, and the pneumatic line coupled together with plastic ties placed at intervals of 3 meters or less. The dual packer injection leaching system may further comprise a leachate solution sprinkler system coupled to the injection line and configured to supply leachate solution to the injection line. The dual packer assembly may further comprise a second upper packer, a second lower packer, and a second high dispersion screen disposed between the second upper packer and the second lower packer, wherein the pneumatic line is coupled to the second upper packer and the second lower packer and configured to inflate the second upper packer and the second lower packer and the dual packer assembly is further configured to deliver the leachate solution through the second high dispersion screen to a second interval of the borehole, the second interval lower than the first interval within the borehole and bounded by the second upper packer and the second lower packer.

Aspects of this document relate to a method of using a dual packer injection leaching system in a leach pile, comprising inserting a dual packer assembly into a borehole in the leach pile, the dual packer assembly comprising an upper packer, a lower packer, and a high dispersion screen disposed between the upper packer and the lower packer, providing a hose reel drum comprising a pneumatic line coupled to the upper packer and the lower packer and an injection line coupled to the high dispersion screen, inflating the upper packer and the lower packer through the pneumatic line to fix a position of the upper packer and the lower packer within the borehole, and delivering a flow of leachate solution through the injection line and the high dispersion screen to a first interval of the borehole bounded by the upper packer and the lower packer.

Particular embodiments may comprise one or more of the following features. The method may further comprise pulsing a pressure of the leachate solution to induce flow into the leach pile. Inserting the dual packer assembly into the borehole may comprise lifting the dual packer assembly with a crane hook. The method may further comprise suspending the dual packer assembly from a chain hoist coupled to a support structure. The method may further comprise coupling the injection line to a leachate solution sprinkler system and supplying leachate solution to the injection line with the leachate solution sprinkler system. The method may further comprise delivering the flow of leachate solution through the injection line to a second interval of the borehole lower than the first interval of the borehole. The borehole may extend into the leach pile at an incline.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
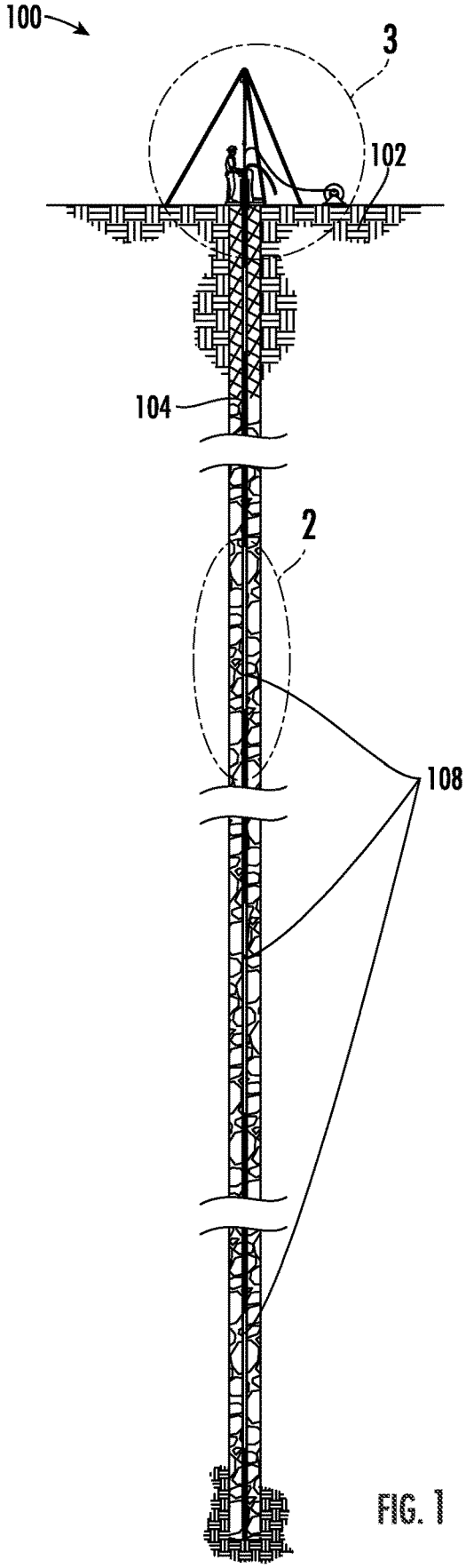
FIG. 1 is a side view of a dual-packer injection leaching system installed within a borehole of a leach pile.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure relates to an injection leaching system 100 configured to provide access to the blinded off portions of the leach pile 102. A borehole 104 is drilled into the leach pile 102. The borehole 104 may extend into the leach pile 102 vertically, horizontally, or at an incline. In some embodiments, a well casing 106 is installed within the borehole 104. The well casing 106 may have a solid wall along a majority of the length of the well casing 106, with intervals 108 of a screened wall. The depth of the screened intervals 108 may be selected based on the specific characteristics of the borehole 104, such as the composition of the leach pile 102, the location of the desired mineral within the leach pile 102, and the location of the barrier blinding off the leach pile 102, among other characteristics. A desired flow path for leaching activity may be selected, and the depth of the screened intervals 108 may be selected based on this desired flow path. The screened intervals 108 may be between 10 and 20 feet in length. The screened intervals 108 may be located at regular intervals, or may have different distances between them. For example, in some embodiments, there may be a fifty-foot solid section of well casing between each screened interval 108. In other embodiments, the solid section of well casing may have a length between 70 and 75 feet, 40 and 60 feet, or any other range. In a specific embodiment, the well casing 106 may have several hundred feet of solid casing, then a ten-foot screened interval 108, a fifty-foot section of solid casing, another ten-foot screened interval 108, a sixty-foot section of solid casing, and a last ten-foot screened interval 108. FIG. 1 illustrates a borehole 104 with multiple screened intervals 108. The injection leaching system 100 may be configured to provide leachate solution to one screened interval 108 at a time, or may be configured to provide leachate solution to multiple screened intervals 108 at a time. In some embodiments, the entire well casing 106 is a screened wall, with no solid portions. Such embodiments have the capability of providing leachate solution at any point along the borehole.

Both the location of the borehole 104 and the depth and location of the screened intervals 108 may be determined based on an investigation of the composition of the leach pile 102. Samples may be taken of the leach pile 102, and then the injection leaching system 100 may be designed to access the portions of the leach pile 102 where mineral rich strata are now known to exist, or to access the portions of the leach pile 102 most blinded off by the hydraulic barrier. Thus, the four general steps of gaining access to the blinded off desired minerals are determining the composition of the leach pile 102, designing the injection leaching system 100, installing the injection leaching system 100, and operating the injection leaching system 100. In addition to determining the location of mineral rich areas, the investigation also aids in determining the required pressures to drive the leachate solution into the surrounding leach pile 102. The investigation may also reveal physical characteristics of the leach pile 102, such as hydraulic conductivities, grain-size distribution, clay content, and chemical signatures, which help in the design of the injection leaching system 100.

Figure 2:
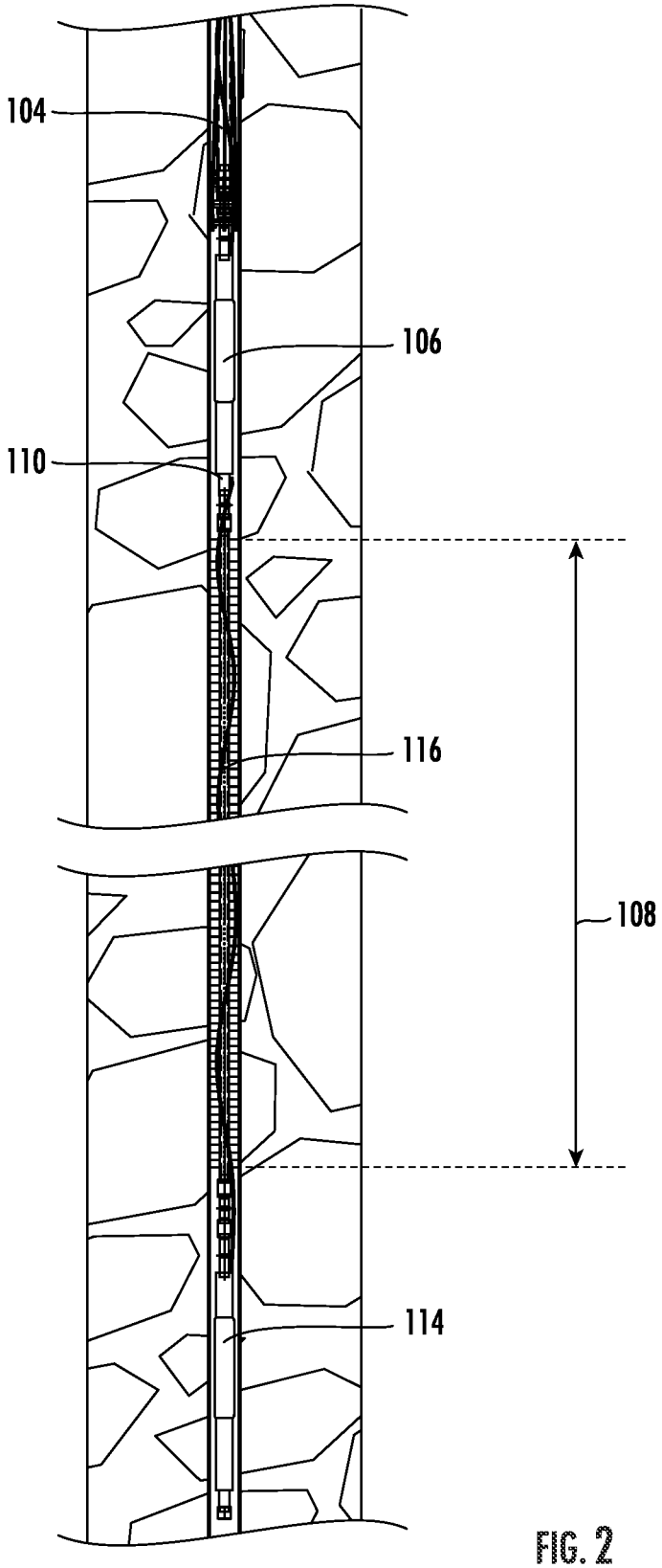
FIG. 2 is a detail view of the interval of the borehole targeted by the dual-packer injection leaching system shown in FIG. 1 taken from circle 2.

FIG. 2 illustrates a close up view of the screened interval 108 targeted by the injection leaching system 100. As shown, the injection leaching system 100 comprises a dual packer assembly 110 configured to be disposed inside the well casing 106. The dual packer assembly 110 comprises a first upper packer 112, a first lower packer 114, and a first high dispersion screen 116 disposed between the first upper packer 112 and the first lower packer 114. The first upper packer 112 and the first lower packer 114 are coupled to a pneumatic line 118 configured to inflate the first upper packer 112 and the first lower packer 114. Typically, the upper packer 112 and the lower packer 114 are inflated with nitrogen, oxygen, or with water. As shown, after being installed within the borehole 104, the dual packer assembly 110 is configured to section off a screened interval 108. This is done by bounding the screened interval 108 with the first upper packer 112 on an upper end of the screened interval 108 and the first lower packer 114 on the lower end of the screened interval 108. Once the upper packer 112 and the lower packer 114 are inflated through the pneumatic line 118, the upper packer 112 and the lower packer 114 limit fluid flow along the borehole, allowing pressure to build between the upper packer 112 and the lower packer 114. The first high dispersion screen 116 is coupled to an injection line 120 configured to provide leachate solution through the first high dispersion screen 116. When the upper packer 112 and the lower packer 114 are inflated, and leachate solution is provided through the high dispersion screen 116, the leachate solution travels into the leach pile along the screened interval 108 and leaches the desired mineral out of the leach pile. By drilling the borehole 104 past the barrier blinding off the location of the leach pile containing the desired mineral, leachate solution can be provided to the location of the desired mineral and make it accessible to leaching activity.

The screen material used for the high dispersion screen 116 is a high dispersion material. A schedule 40 or schedule 80 polyvinyl chloride (PVC) recovery well screen is typical for other boreholes, but is not sufficient for the present application because of the associated head loss that occurs when pumping the leachate solution or water through the high dispersion screen 116. Thus, the high dispersion screen 116 may be a stainless steel high dispersion screen. As non-limiting examples, the high dispersion screen 116 may be a Roscoe stainless steel high dispersion water well screen or a Johnson stainless steel high dispersion water well screen.

In some embodiments, the dual packer assembly 110 may further comprise a second upper packer 112, a second lower packer 114, and a second high dispersion screen 116 disposed between the second upper packer 112 and the second lower packer 114. In such embodiments, the pneumatic line 118 is coupled to the second upper packer 112 and to the second lower packer 114, and is configured to inflate each of the second upper packer 112 and the second lower packer 114. Additionally, the dual packer assembly 110 is configured to deliver the leachate solution through the second high dispersion screen 116 to a second interval 108 of the borehole 104. The second interval 108 may be lower than the first interval 108 within the borehole 104, and may be bounded by the second upper packer 112 and the second lower packer 114. Some embodiments include additional sets of an upper packer 112, a lower packer 114, and a high dispersion screen 116 to allow the dual packer assembly 110 to provide leachate solution to multiple screened intervals 108 simultaneously.

Figure 3:
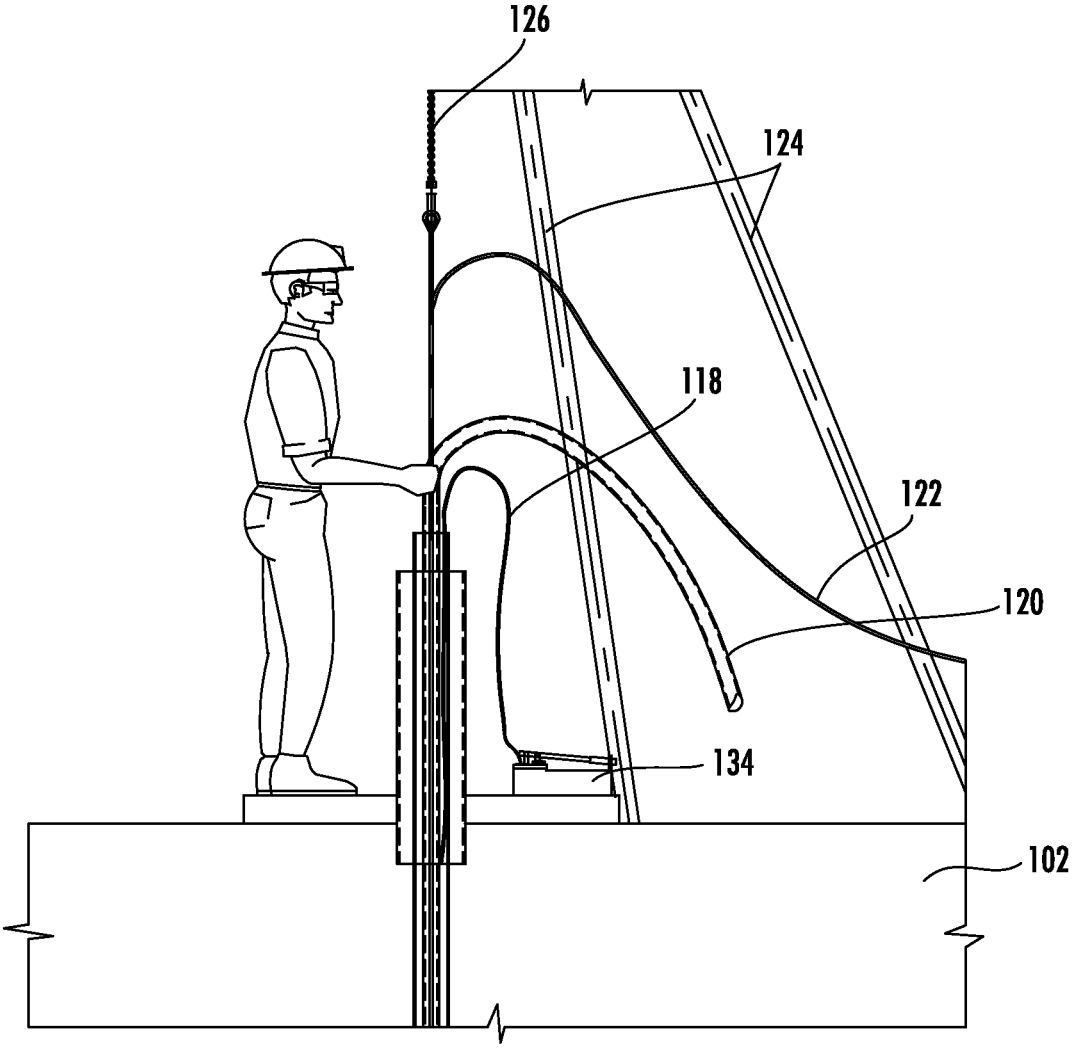
FIG. 3 is a detail view of the surface equipment of the dual-packer injection leaching system shown in FIG. 1 taken from circle 3.
Figure 13:
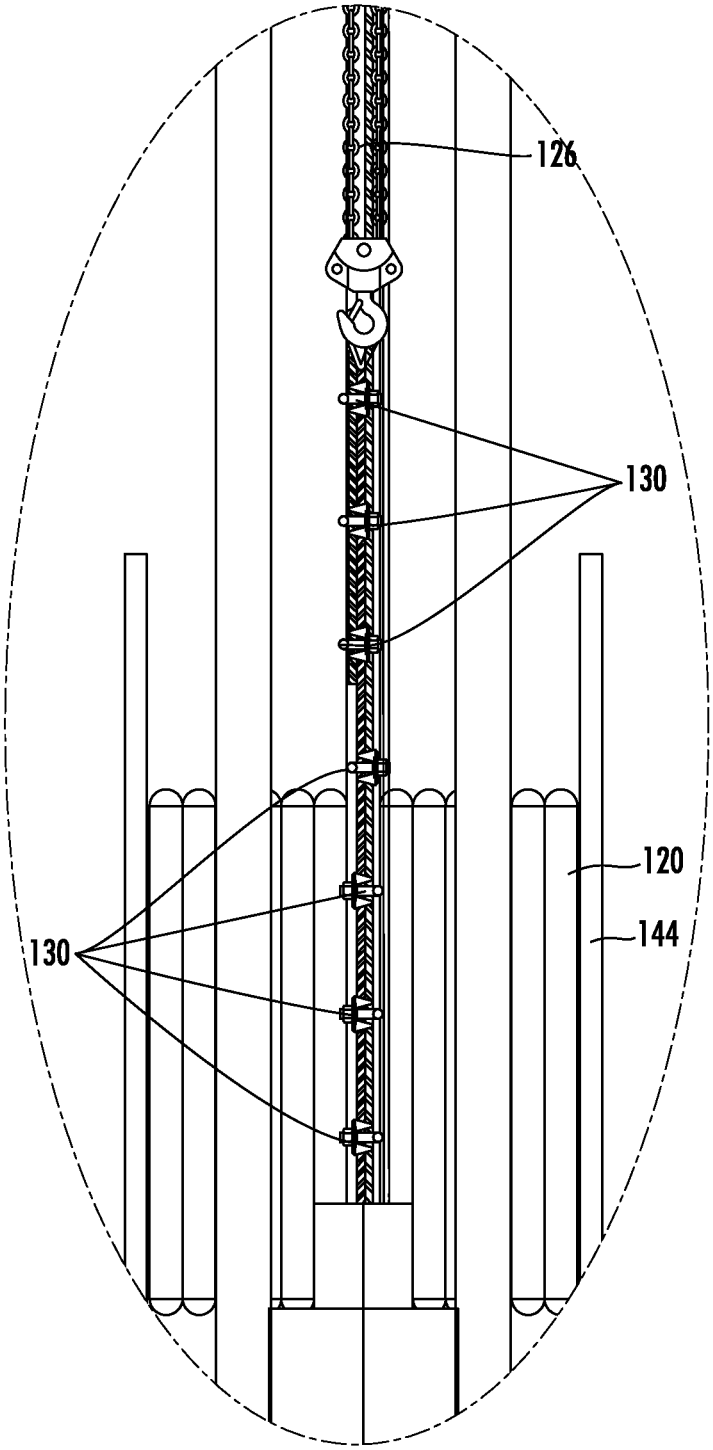
FIG. 13 is a detail view of the dual-packer injection leaching system shown in FIG. 12 taken from circle 13.

Moving to FIG. 3, the injection leaching system 100 also comprises surface equipment configured to support the dual packer assembly 110 within the borehole 104. The surface equipment includes a wire rope 122 and a support structure 124 configured to support the dual packer assembly 110. The support structure 124 may be a tripod or some other structure. The dual packer assembly 110 may be coupled to the wire rope 122, and the wire rope 122 may be coupled to the support structure 124 through a chain hoist 126 hanging from the support structure 124 and a wire rope extension 128. As shown in more detail in FIGS. 5 and 13, the wire rope extension 128 allows the wire rope 122 to be coupled to the wire rope extension 128 at any point along the length of the wire rope 122 through the use of a plurality of wire rope clips 130, and provides a hoist hook 132 to which the chain hoist 126 can couple. Also shown in FIG. 3, the pneumatic line 118 and the injection line 120 extend up the borehole 104 from the dual packer assembly 110 and exit the borehole 104 at the surface. Thus, each of the wire rope 122, the pneumatic line 118, and the injection line 120 extend from the dual packer assembly 110 to the surface of the borehole 104. The wire rope 122, the pneumatic line 118, and the injection line 120 may be coupled together with plastic ties placed at intervals of 3 meters or less, or 2 meters or less. This helps to prevent excessive tangling and facilitates the use of the dual packer assembly 110. The pneumatic line 118 couples with a pump 134 used to inflate the upper packer 112 and the lower packer 114. The injection line couples with a source of leachate solution, such as a leachate solution sprinkler system 136 (see FIG. 9). The leachate solution sprinkler system 136 is the system already used in leach piles 102 to conduct leaching activity from the surface of the leach pile 102.

Figure 4:
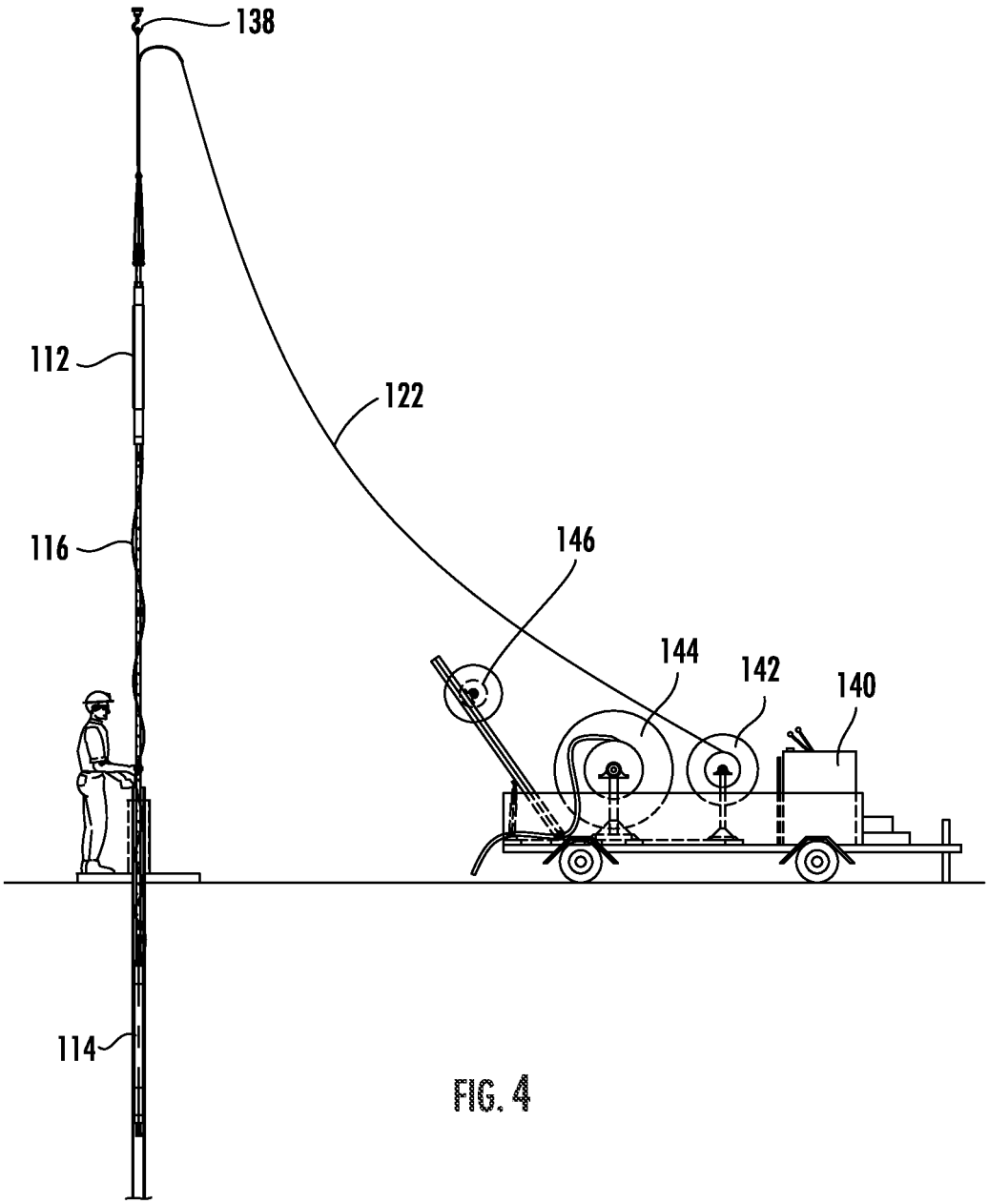
FIG. 4 is a side view of the dual-packer injection leaching system shown in FIG. 1 lifted by a crane hook to be installed in the borehole.

Moving to FIG. 4, the injection leaching system 100 also comprises surface equipment configured to support and aid in the deployment of the dual packer assembly 110. For example, the injection leaching system 100 may further comprise a crane hook 138 and a mobile deployment system 140. The crane hook 138 is configured to support the dual packer assembly 110 during installation of the dual packer assembly 110 inside the well casing 106 or borehole 104. The mobile deployment system 140 is configured to be disposed adjacent the borehole 104. The mobile deployment system 140 may comprise a wire rope reel drum 142 configured to receive and store excess lengths of the wire rope 122 that are not in use when the dual packer assembly 110 is at a smaller depth within the borehole 104. In addition, the mobile deployment system 140 may comprise a hose reel drum 144 configured to receive and store excess lengths of the pneumatic line 118 and the injection line 120. The wire rope reel drum 142 and the hose reel drum 144 may be motorized. A bend pulley 146 may be coupled to the mobile deployment system 140. The bend pulley 146 is used during installation of the dual packer assembly 110 within the borehole 104, as will be explained further below.

Figure 5:
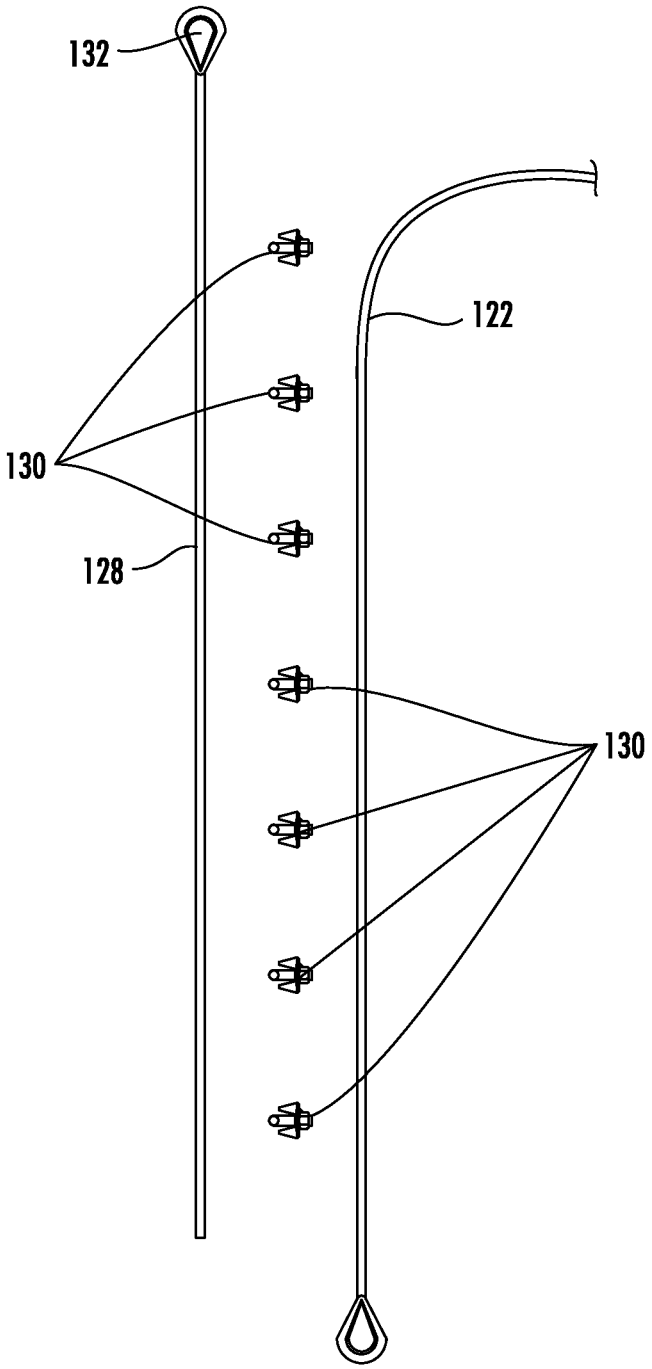
FIG. 5 is an exploded view of the connection between the wire rope extension and the wire rope of the dual-packer injection leaching system shown in FIG. 1.
Figure 6:
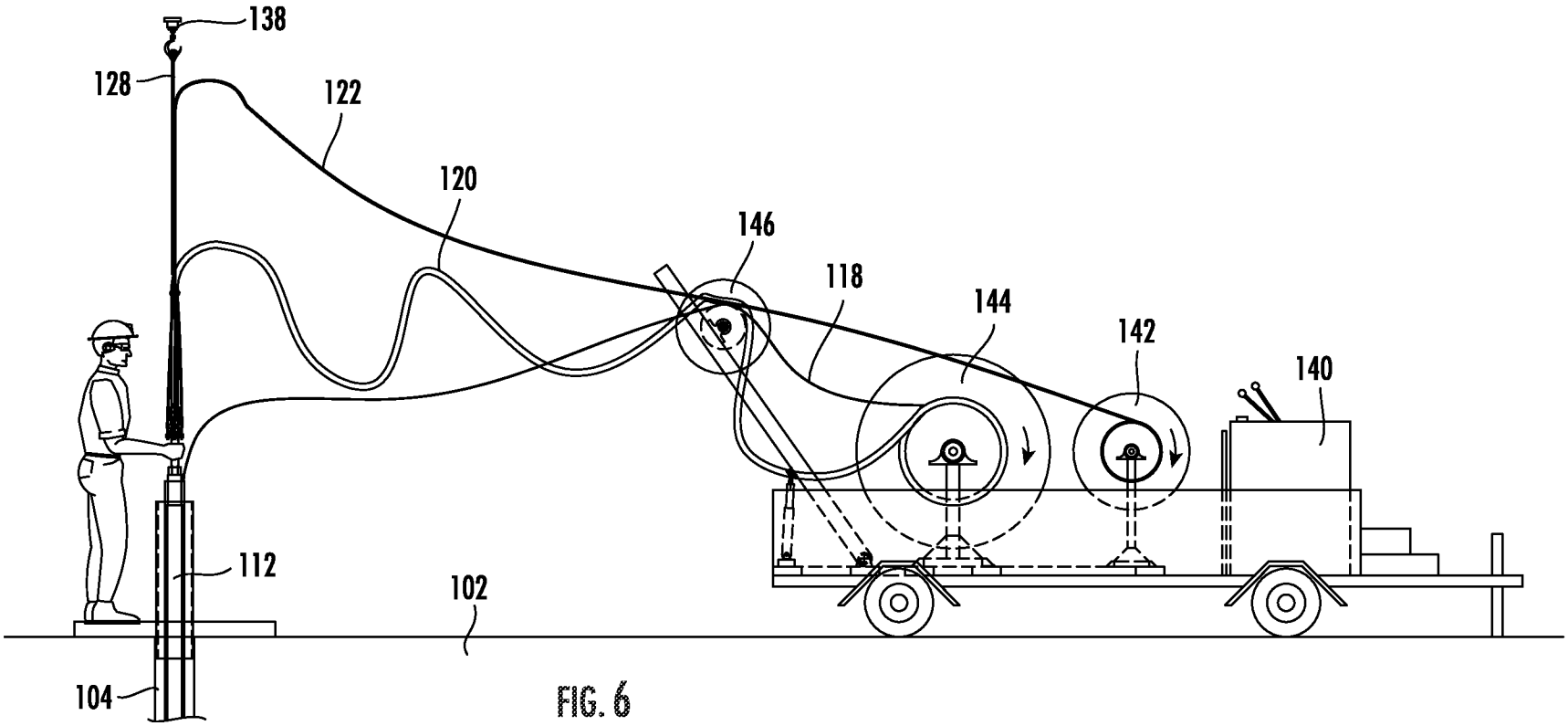
FIG. 6 is a side view of the dual-packer injection leaching system shown in FIG. 4 lowered partially into the borehole.

As shown in FIG. 4, the crane hook 138 may be used to lift the dual packer assembly 110 and align the dual packer assembly 110 with the borehole 104. The crane hook 138 may then lower the dual packer assembly 110 down into the borehole 104. The crane hook 138 is useful because of the length of the dual packer assembly 110. As mentioned above, the crane hook 138 may be coupled to the dual packer assembly 110 through the wire rope extension 128. FIG. 5 illustrates how the wire rope 122 is coupled to the wire rope extension 128. The wire rope 122 and the wire rope extension 128 are clipped together using the plurality of wire rope clips 130 (see FIG. 13). Once the dual packer assembly 110 is aligned with the borehole 104, the dual packer assembly 110 is lowered into the borehole 104, as shown in FIG. 6. As the dual packer assembly 110 is lowered into the borehole 104, the pneumatic line 118, the injection line 120, and the wire rope 122 are fed down the borehole as well. At regular intervals, such as every 3 meters or less, the pneumatic line 118, the injection line 120, and the wire rope 122 may be tied together with plastic ties. Alternatively, the pneumatic line 118, the injection line 120, and the wire rope 122 may be tied together ahead of time and wrapped around one reel drum that comprises the wire rope reel drum 142 and the hose reel drum 144 so that, during installation, they are already tied together.

Figure 7:
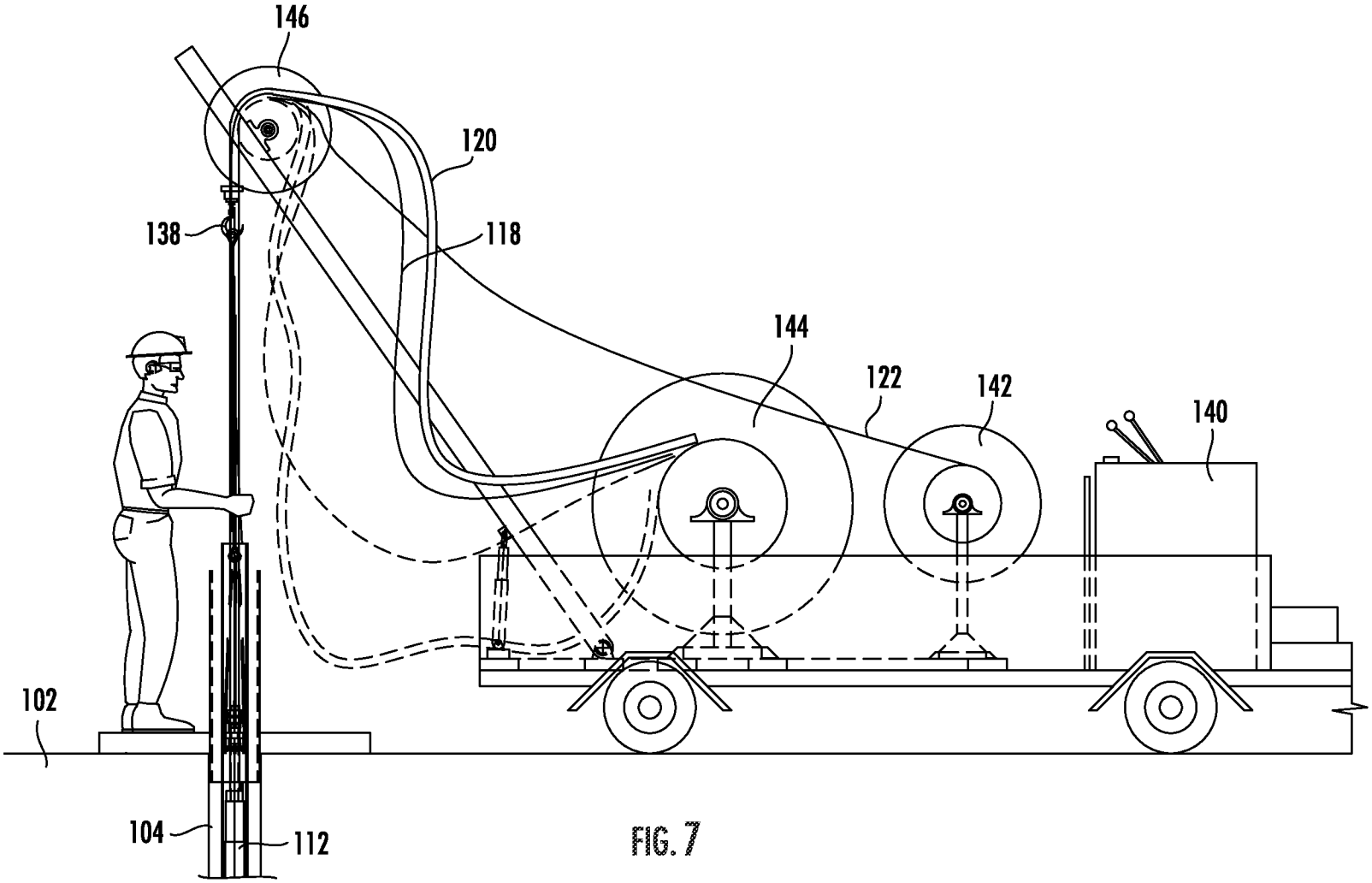
FIG. 7 is a side view of the dual-packer injection leaching system shown in FIG. 4 with the deployment system aligned with the borehole.

Once the dual packer assembly 110 has been lowered into the borehole 104 just past the surface, the mobile deployment system 140 is moved closer to the borehole 104 to align the bend pulley 146 with the borehole 104, as shown in FIG. 7. As the mobile deployment system 140 is moved closer, the wire rope reel drum 142 and the hose reel drum 144 rotate to wind up the pneumatic line 118, the injection line 120, and the wire rope 122. The wire rope reel drum 142 is tightened to remove the tension from the wire rope extension 128, and the wire rope clips 130 and the wire rope extension 128 can be removed from the wire rope 122, so that the mobile deployment system 140 is supporting the dual packer assembly 110. The mobile deployment system 140 then unrolls the wire rope reel drum 142 to lower the dual packer assembly 110 further into the borehole 104 to the location of the desired screened interval 108 where leaching activity is to take place.

Figure 8:
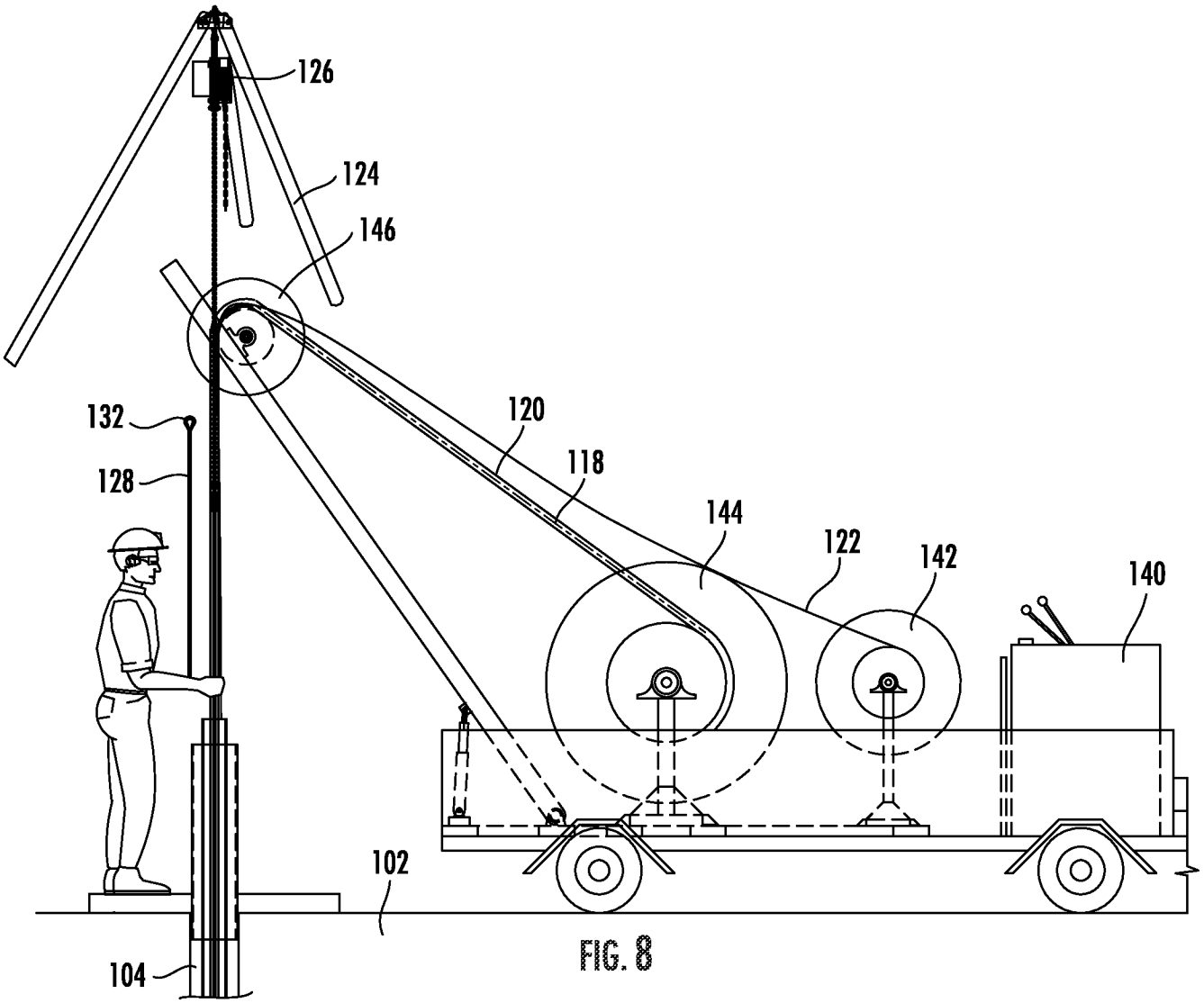
FIG. 8 is a side view of the dual-packer injection leaching system shown in FIG. 4 with the support of the dual-packer injection leaching system shifted from the crane hook to the deployment system.
Figure 9:
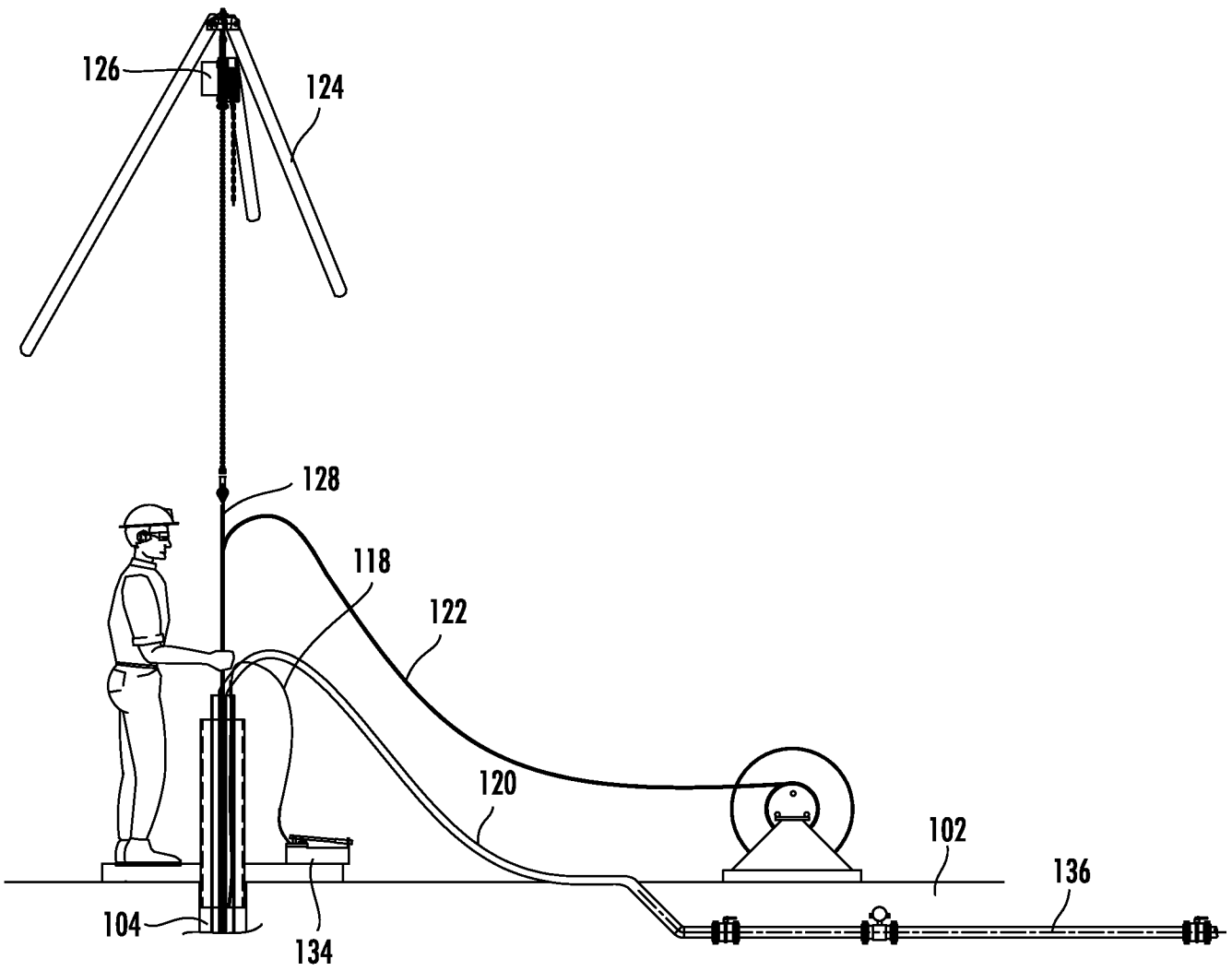
FIG. 9 is a side view of the dual-packer injection leaching system shown in FIG. 4 once the dual-packer injection leaching system is suspended from the tripod and the deployment system has been removed.
Figure 10:
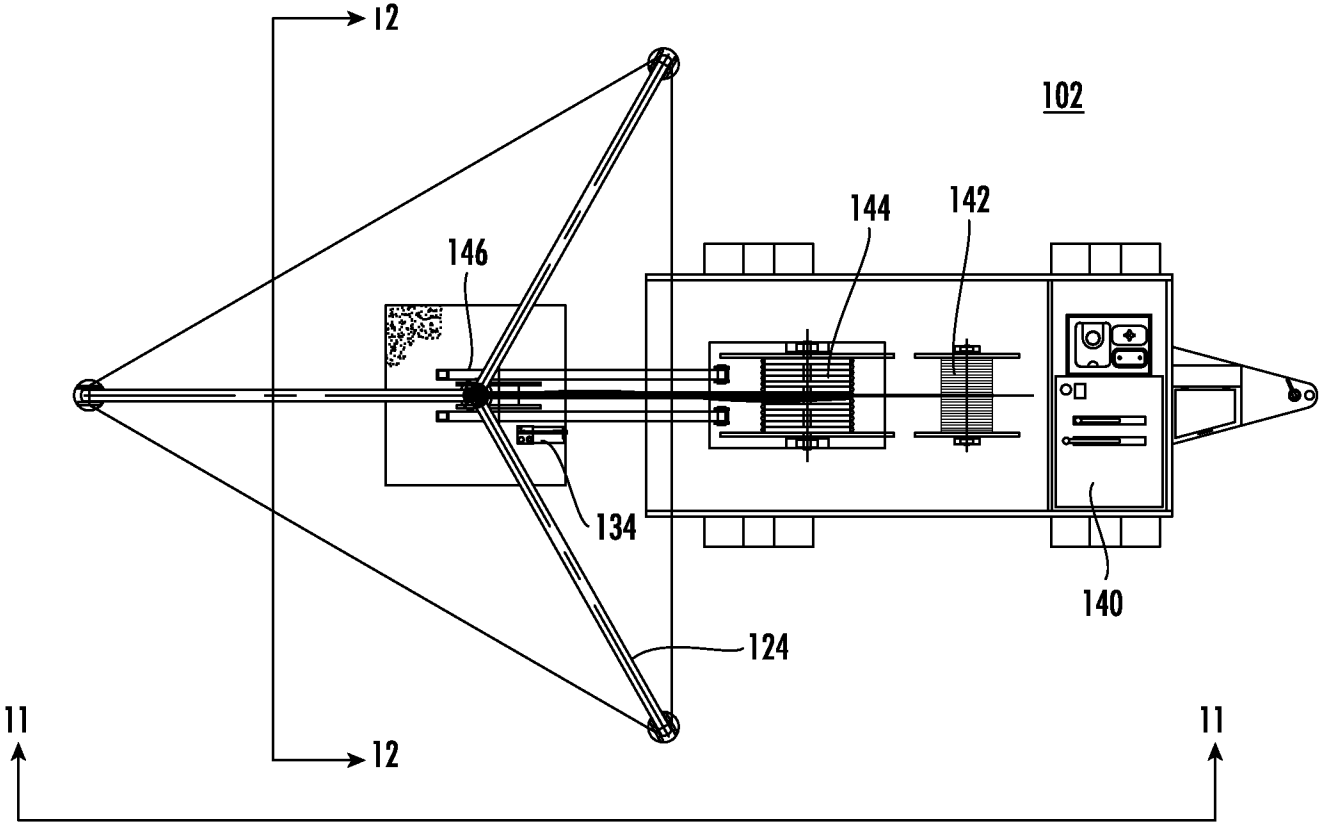
FIG. 10 is a top view of the dual-packer injection leaching system shown in FIG. 1 with the deployment system attached.
Figure 11:
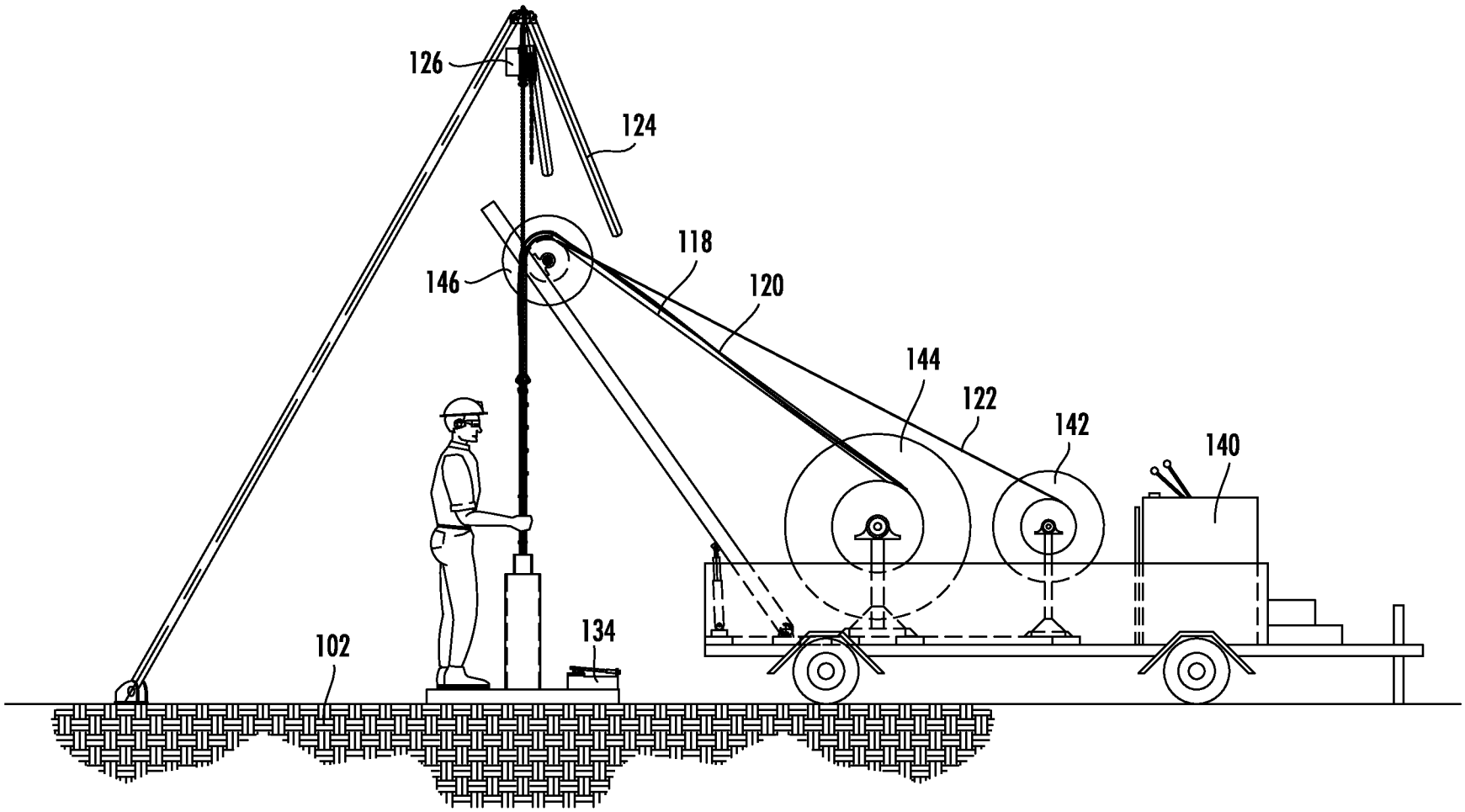
FIG. 11 is a side view of the dual-packer injection leaching system shown in FIG. 10 taken along line 11-11.
Figure 12:
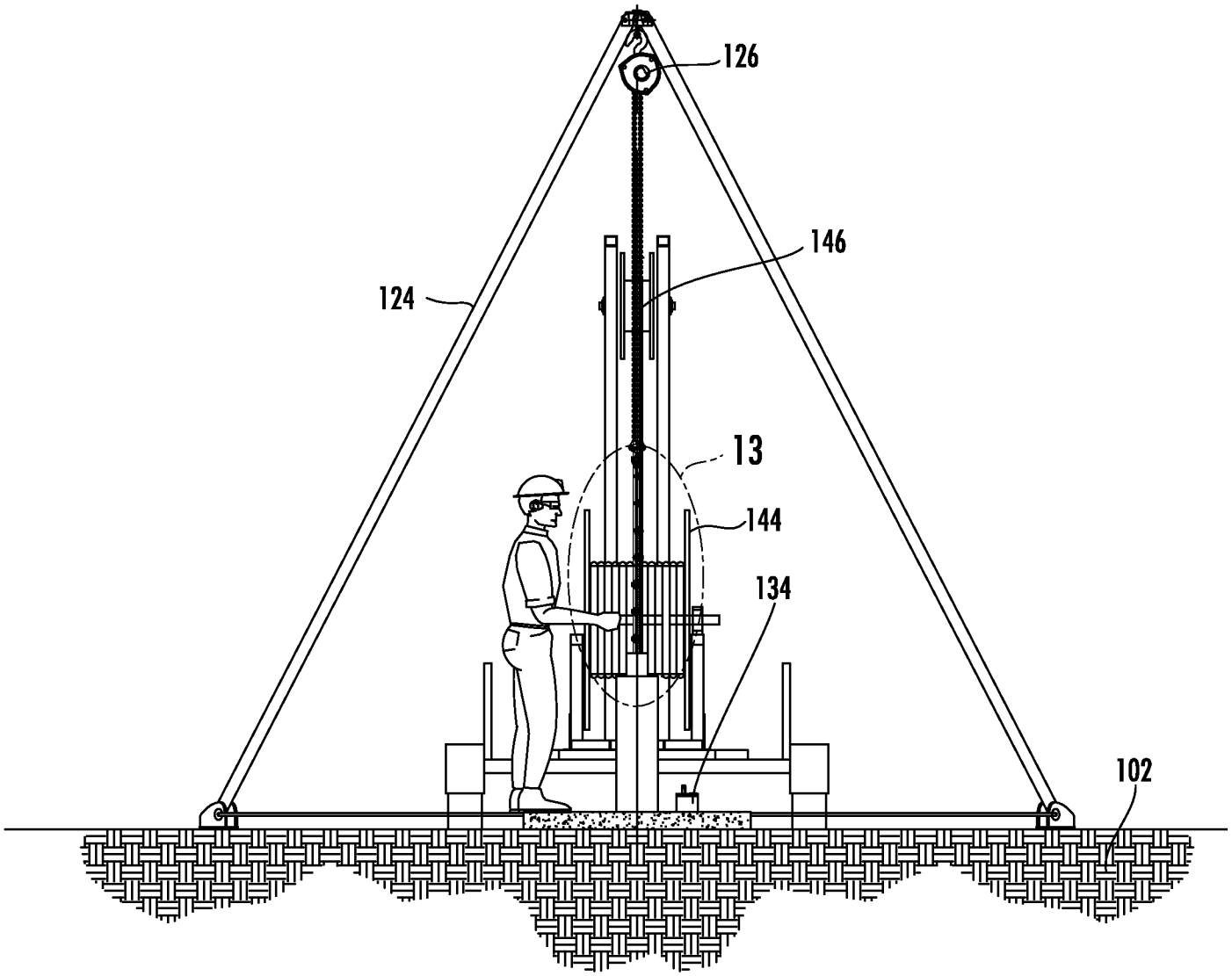
FIG. 12 is a back view of the dual-packer injection leaching system shown in FIG. 10 taken along line 12-12.

The support structure 124, such as a tripod as shown in FIG. 8, may be installed over the borehole 104 with the chain hoist 126 coupled to the wire rope extension 128. The wire rope clips 130 may then be used to couple the wire rope extension 128 to the wire rope 122, transferring the weight of the dual packer assembly 110 to the support structure 124. This allows the mobile deployment system 140 to then be removed from adjacent the borehole 104. FIG. 9 illustrates how the injection line 120 may be coupled to the leachate solution sprinkler system 136 to supply leachate solution to the injection leaching system 100. FIGS. 10-13 provide additional views of the injection leaching system 100 suspended from the support structure 124.

A method for using the injection leaching system 100 in a leach pile may comprise inserting the dual packer assembly 110 into the borehole 104 in the leach pile 102, providing a hose reel drum 144 with a pneumatic line 118 and an injection line 120, inflating the upper packer 112 and the lower packer 114 through the pneumatic line 118 to fix a position of the upper packer 112 and the lower packer 114 within the borehole 104, and delivering a flow of leachate solution through the injection line 120 and the high dispersion screen 116 of the dual packer assembly 110 to an interval 108 of the borehole 104 bounded by the upper packer 112 and the lower packer 114. As described above, the borehole 104 penetrates the barrier blinding off the leach pile 102, and thus the blinded off area can be supplied with leachate solution for leaching activity. As leachate solution is delivered to the interval 108, the leachate solution flows into the surrounding leach pile 102. Because horizontal conductivity of fluid is greater than vertical conductivity, this leach activity is able to penetrate horizontally into the leach pile before filtering downward to be collected. Generally, the leachate solution used is a sulfuric acid, which may be diluted. However, other fluids may be used for leaching. In addition, the leachate solution may be replaced with water, and the method may include rinsing the interval 108 with water. The method may also include pulsing the pressure of the leachate solution to induce flow into the leach pile 102. The inflated upper packer 112 and lower packer 114 allow the pressure to increase over the interval 108. In addition, the method may include pumping air through the injection line 120 and pulsing the air pressure. An air compressor, a windmill, or some other air pump could be used to pump the air. Bacteria within the leach pile 102 increases the leach rate of the leaching activity. Thus, it is beneficial to provide air to the leach pile, to help bacteria flourish.

Inserting the dual packer assembly 110 into the borehole 104 may comprise lifting the dual packer assembly 110 with a crane hook 138. The method may also comprise suspending the dual packer assembly 110 from the chain hoist 126 coupled to the support structure 124, and may comprise coupling the injection line 120 to the leachate solution sprinkler system 136 and supplying leachate solution to the injection line 120 with the leachate solution sprinkler system 136. The method may further comprise delivering the flow of leachate solution through the injection line 120 to a second interval 108 of the borehole 104 lower than the first interval 108 of the borehole 104.

Another method for using the injection leaching system 100 in a leach pile 102 may include the following steps, as illustrated by FIGS. 4-9. The pneumatic line 118, injection line 120, and the wire rope 122 may be extended on the ground and marked to indicate the location of each that will be level with the surface of the leach pile 102 when the dual packer assembly 110 is at the desired depth within the borehole 104. The pneumatic line 118, injection line 120, and wire rope 122 may be bundled together using cable straps at intervals of 6 feet. The pneumatic line 118 and the injection line 120 may be loaded onto the hose reel drum 144 and the wire rope 122 may be loaded onto the wire rope reel drum 142. The wire rope extension 128 may be coupled to the wire rope 122 using the wire rope clips 130. The dual packer assembly 110 may be lifted with the crane hook 138 through the wire rope extension 128. The dual packer assembly 110 may be aligned with the borehole 104 and lowered slightly into the borehole 104 until the dual packer assembly 110 is lower than the bend pulley 146. Then the mobile deployment system 140 may be moved to align the bend pulley 14 with the wire rope 122. The wire rope 122 may be tightened to remove the weight of the dual packer assembly 110 from the crane hook 138. The crane hook 138 and the wire rope extension 128 may then be removed. The wire rope reel drum 142 may then be rotated to lower the dual packer assembly 110 into the borehole 104 until the high dispersion screen 116 is aligned with the desired screened interval 108. As the dual packer assembly 110 descends, plastic ties may be tied around the wire rope 122, the pneumatic line 118, and the injection line 120. The support structure 124, such as a tripod, may be placed above the borehole 104 with a chain hoist 126. The wire rope extension 128 may be coupled to the wire rope 122 with the wire rope clips 130. The chain hoist 126 may be used to release the tension from the bend pulley 146 and the mobile deployment system 140. The mobile deployment system 140 may then be removed. The injection line 120 may be coupled to a leachate solution source, such as the leachate solution sprinkler system 136. The pneumatic line 118 may be coupled to a nitrogen tank or a water pump. The upper packer 112 and the lower packer 114 may then each be inflated to a pressure between 195 psi and 205 psi. Other pressure may also be used. Leachate solution may then be injected to the desired interval 108 through the injection line 120. Pulsing of the pressure of the leachate solution may be used to induce flow into the leach pile 102.

In embodiments where a new screened interval is selected, the mobile deployment system 140 may be placed adjacent the borehole 104 again, and the mobile deployment system 140 may be used to adjust the depth of the dual packer assembly 110 to the new desired screened interval 108. The dual packer assembly 110 may then be installed again as explained above, where the weight of the dual packer assembly 110 is transferred again to the support structure 124, the packers 112, 114 are inflated, and the leachate solution is injected to the desired screened interval 108.

It will be understood that implementations of an injection leaching system are not limited to the specific assemblies, devices and components disclosed in this document, as virtually any assemblies, devices and components consistent with the intended operation of an injection leaching system may be used. Accordingly, for example, although particular injection leaching systems, and other assemblies, devices and components are disclosed, such may include any shape, size, style, type, model, version, class, measurement, concentration, material, weight, quantity, and/or the like consistent with the intended operation of injection leaching systems. Implementations are not limited to uses of any specific assemblies, devices and components; provided that the assemblies, devices and components selected are consistent with the intended operation of an injection leaching system.

Accordingly, the components defining any injection leaching system may be formed of any of many different types of materials or combinations thereof that can readily be formed into shaped objects provided that the materials selected are consistent with the intended operation of an injection leaching system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various injection leaching systems may be manufactured using conventional procedures as added to and improved upon through the procedures described here. Some components defining an injection leaching system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling injection leaching systems are not limited to the specific order of steps as disclosed in this document. Any steps or sequence of steps of the assembly of an injection leaching system indicated herein are given as examples of possible steps or sequence of steps and not as limitations, since various assembly processes and sequences of steps may be used to assemble injection leaching systems.

The implementations of an injection leaching system described are by way of example or explanation and not by way of limitation. Rather, any description relating to the foregoing is for the exemplary purposes of this disclosure, and implementations may also be used with similar results for a variety of other applications employing an injection leaching system.

What is claimed is:

1. A dual packer injection leaching system, comprising:

a dual packer assembly configured to be disposed inside a well casing within a borehole in a leach pile, the dual packer assembly comprising a first upper packer, a first lower packer, and a first dispersion screen disposed between the first upper packer and the first lower packer, and a second upper packer, a second lower packer, and a second dispersion screen disposed between the second upper packer and the second lower packer;

a crane hook configured to support the dual packer assembly during installation of the dual packer assembly inside the well casing;

a mobile deployment system configured to be disposed adjacent the borehole, the mobile deployment system comprising:

a wire rope coiled around a wire rope reel drum, the wire rope further coupled to the dual packer assembly, and a hose reel drum comprising a pneumatic line and an injection line, the pneumatic line coupled to the first upper packer and the first lower packer and the second upper packer and the second lower packer and configured to inflate the first upper packer and the first lower packer and the second upper packer and the second lower packer, and the injection line configured to provide leachate solution through the first dispersion screen and the second dispersion screen; and a support structure coupled to a chain hoist, the chain hoist coupled to the dual packer assembly and configured to support the dual packer assembly and provide for a release of the crane hook from the dual packer assembly;

wherein the dual packer assembly is configured to deliver the leachate solution through the first dispersion screen to a first interval of the borehole bounded by the first upper packer and the first lower packer and through the second dispersion screen to a second interval of the borehole, the second interval lower than the first interval within the borehole and bounded by the second upper packer and the second lower packer.

2. The dual packer injection leaching system of claim 1, further comprising the wire rope, the injection line, and the pneumatic line coupled together with plastic ties placed at intervals of 3 meters or less.

3. The dual packer injection leaching system of claim 1, further comprising a leachate solution sprinkler system coupled to the injection line and configured to supply leachate solution to the injection line.

4. The dual packer injection leaching system of claim 1, wherein the borehole extends into the leach pile at an incline.

5. A dual packer injection leaching system, comprising:

a dual packer assembly configured to be disposed inside a borehole in a leach pile, the dual packer assembly comprising a first upper packer, a first lower packer, and a first dispersion screen disposed between the first upper packer and the first lower packer, and a second upper packer, a second lower packer, and a second dispersion screen disposed between the second upper packer and the second lower packer; and a hose reel drum comprising a pneumatic line and an injection line, the pneumatic line coupled to the first upper packer and the first lower packer and the second upper packer and the second lower packer and configured to inflate the first upper packer and the first lower packer and the second upper packer and the second lower packer, and the injection line configured to provide leachate solution through the first dispersion screen and the second dispersion screen;

wherein the dual packer assembly is configured to deliver the leachate solution through the first dispersion screen to a first interval of the borehole bounded by the first upper packer and the first lower packer and through the second dispersion screen to a second interval of the borehole, the second interval lower than the first interval within the borehole and bounded by the second upper packer and the second lower packer.

6. The dual packer injection leaching system of claim 5, further comprising a crane hook configured to support the dual packer assembly during installation of the dual packer assembly inside the borehole.

7. The dual packer injection leaching system of claim 5, further comprising a support structure coupled to a chain hoist, the chain hoist coupled to the dual packer assembly and configured to support the dual packer assembly.

8. The dual packer injection leaching system of claim 5, wherein the borehole extends into the leach pile at an incline.

9. The dual packer injection leaching system of claim 5, further comprising a wire rope coiled around a wire rope reel drum, the wire rope further coupled to the dual packer assembly.

10. The dual packer injection leaching system of claim 9, further comprising the wire rope, the injection line, and the pneumatic line coupled together with plastic ties placed at intervals of 3 meters or less.

11. The dual packer injection leaching system of claim 5, further comprising a leachate solution sprinkler system coupled to the injection line and configured to supply leachate solution to the injection line.

* * * * *